United States Patent [19]

Rathbone

[11] Patent Number: 4,883,517

[45] Date of Patent: Nov. 28, 1989

[54] AIR SEPARATION

[75] Inventor: Thomas Rathbone, Farnham, United Kingdom

[73] Assignee: The BOC Group, Inc., New Providence, N.J.

[21] Appl. No.: 297,145

[22] Filed: Jan. 13, 1989

[30] Foreign Application Priority Data

Jan. 14, 1988 [GB] United Kingdom ..... 8800842

[51] Int. Cl.[4] ..... F25J 3/04

[52] U.S. Cl. ..... 62/22; 62/24; 55/66

[58] Field of Search ..... 62/11, 22, 23, 24; 55/66

[56] References Cited

U.S. PATENT DOCUMENTS

| | | | |
|---|---|---|---|
| 4,057,407 | 11/1977 | Bigi | 62/22 |
| 4,702,757 | 10/1987 | Kleinberg | 62/24 |
| 4,704,147 | 11/1987 | Kleinberg | 62/24 |
| 4,704,148 | 11/1987 | Kleinberg | 62/24 |
| 4,783,210 | 11/1988 | Ayres et al. | 62/24 |
| 4,822,395 | 4/1989 | Cheung | 62/24 |

FOREIGN PATENT DOCUMENTS

| | | |
|---|---|---|
| 2169561 | 7/1972 | European Pat. Off. . |
| 0081178 | 11/1982 | European Pat. Off. . |
| 0259070 | 8/1987 | European Pat. Off. . |

*Primary Examiner*—Ronald C. Capossela
*Attorney, Agent, or Firm*—Carol A. Nemetz; R. Hain Swope; Larry R. Cassett

[57] ABSTRACT

Purified air, typically at its dew point, is introduced into distillation column 10 through inlet 2. Oxygen-rich liquid is withdrawn through outlet 6 and is introduced into the top of a mixing column 20. Nitrogen-rich vapor passes from the top of the distillation column 10 to the bottom of the mixing column 20. In the mixing column, there is a downward flow of liquid that becomes progressively richer in nitrogen and an upward flow of vapor that becomes progressively richer in oxygen. Liquid nitrogen is withdrawn from the mixing column 20 through outlet 28 and is returned to the top of distillation column 10 to provide reflux therefor. In addition, a mixed stream comprising oxygen and nitrogen is withdrawn from the column 20 as product or waste. The mixing column 20 is provided with a first condenser 30 at its top and a second condenser 40 which takes a vapor stream from intermediate the outlet 28 and the top of the column 20 and returns condensed liquid to the column 20. The second condensation is effected by heat exchange with boiling liquid taken from and returned to the column 10. An argon-enriched oxygen stream is withdrawn from the column 10 and is separated in a second distillation column 50 to yield an argon product.

16 Claims, 2 Drawing Sheets

AIR SEPARATION

This invention relates to a process and apparatus for separating argon from air.

BACKGROUND OF THE INVENTION

Traditionally, to obtain argon as a product gas, incoming air is separated into relatively pure streams of oxygen, nitrogen and argon. European Patent Application No. 136 926A relates to the operation of a conventional double column with argon "side-draw" for producing nitrogen, oxygen and argon products. The disclosed process takes advantage of a temporary fall in the oxygen demand in order to increase the production of one or more of the other products, for example argon. A liquid is thus taken from one of the two columns forming the double column and passed to the top of an auxiliary or mixing column operating at substantially the pressure of low pressure column. A gas having a lower oxygen content than the liquid is taken from the low pressure column and passed to the bottom of the auxiliary column. A liquid collected at the bottom of the auxiliary column is passed as reflux into the low pressure column at substantially the level from which the said gas is taken. As more oxygen-rich liquid is taken from the double column and passed to the auxiliary column so more reflux may be provided for the low pressure column, thereby making possible an increase in the rate of argon production. However, this method involves substantial inefficiencies which makes it unsuitable for use in a plant for producing argon as the primary or sole product of air separation. Our UK Patent Application No. 2 174 916 A relates to a process of separating argon from air wherein there is provided an improvement in the operation of the auxiliary or mixing zone. The present invention relates to a process and apparatus for separating argon from air which enables further improve- ment to be obtained in the operation of the mixing zone.

SUMMARY OF THE INVENTION

According to the present invention there is provided a process of separating air comprising the steps of passing a stream of air into a first distillation column, withdrawing from a bottom region thereof an oxygen-enriched liquid which is passed to a top region of a mixing zone, passing nitrogen-rich vapor from the first distillation column to a bottom region of the mixing zone, establishing through the mixing zone a downward flow of liquid that becomes progressively richer in nitrogen in the direction of liquid flow and an upward flow of vapor that becomes progressively richer in oxygen in the direction of vapor flow, passing liquid nitrogen from the mixing zone to the first distillation column to act as reflux therein, withdrawing from a chosen level of the mixing zone as product or waste a mixed stream comprising oxygen and nitrogen, providing condensation for oxygen-rich vapor at the top of the mixing zone, withdrawing from the first distillation column a stream of argon-containing fluid whose argon concentration is greater than that of the air stream, separating an argon product therefrom in a second distillation column, withdrawing from a level of the mixing zone intermediate the top and the level from which said mixed stream is withdrawn a vapor stream which is condensed in heat exchange with a stream of boiling liquid from one of the distillation columns, returning a stream of thus-formed condensate to the mixing zone, and returning boiled liquid to its respective distillation column.

The invention also provides apparatus for separating air, comprising: means for passing a stream of air into a first distillation column; means for withdrawing an oxygen-rich liquid from a bottom region of the first distillation column and passing it to a top region of a mixing zone; means for passing nitrogen-rich vapor withdrawn from the first distillation column to a bottom region of the mixing zone; liquid-vapor contact means for establishing through the mixing zone a downward flow of liquid that becomes progressively richer in nitrogen in the direction of liquid flow and an upward flow of vapor that becomes progressively richer in oxygen in the direction of vapor flow; means for passing liquid nitrogen from the mixing zone to the first distillation column to act as reflux; means for withdrawing as product or waste a mixed stream comprising oxygen and nitrogen from a chosen level of the mixing zone; a condenser for condensing oxygen-rich vapor at the top of the mixing zone; means for withdrawing from the first distillation column a stream of argon-containing fluid whose argon concentration is greater than that of the air stream said means communicating with a second distillation column for separating an argon product from the argon-containing stream; means for withdrawing a vapor stream from a level of the mixing zone intermediate the top and the level from which said mixed stream is in operation withdrawn; means for condensing said vapor stream in heat exchange with a stream of boiling liquid from one of the distillation columns, and means for returning a stream of thus-formed condensate to the mixing zone, and means for returning boiled liquid to its respective distillation column.

BRIEF DESCRIPTION OF THE DRAWINGS

In the accompanying drawings which illustrate a process and equipment according to the invention.

DETAILED DESCRIPTION OF THE INVENTION

Figure 1:
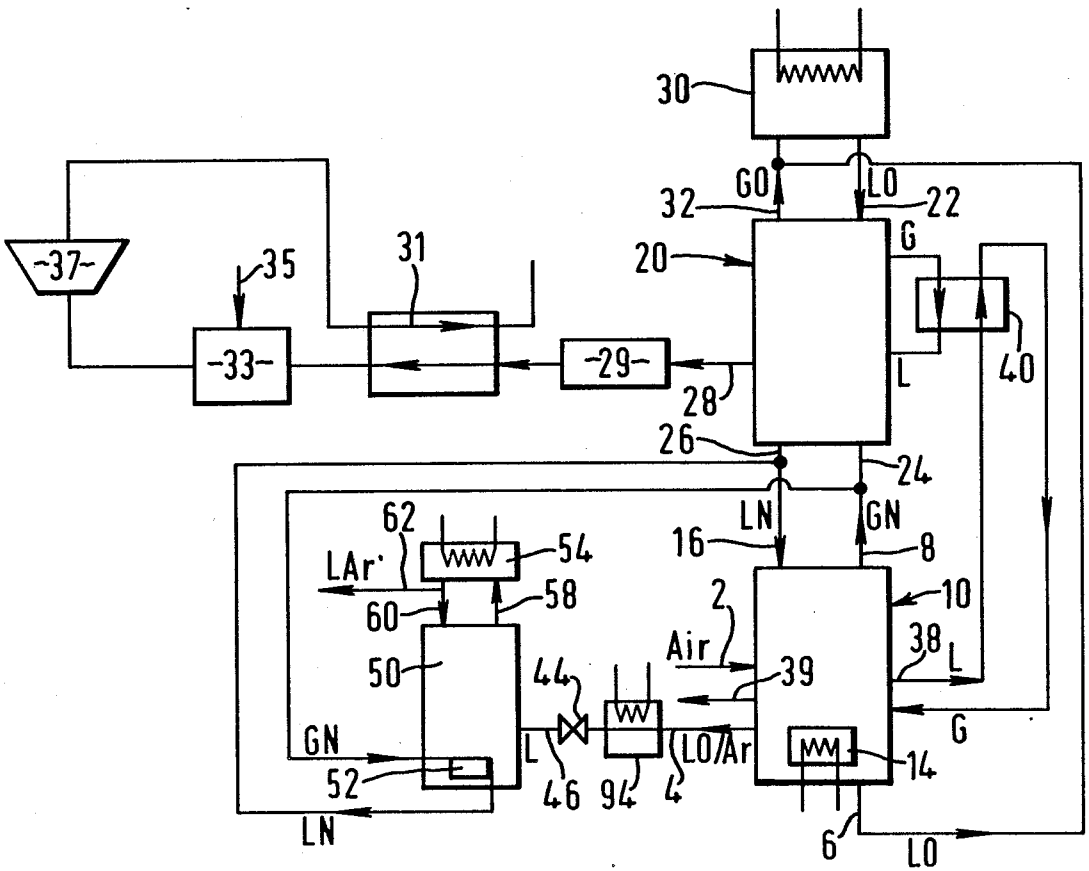
FIG. 1 is a simplified circuit diagram illustrating an arrangement of liquid-vapor contact columns for use in generating argon in accordance with the invention.

Referring to FIG. 1, an air stream from which low volatility constituents and impurities, such as carbon dioxide and water vapor, have been removed is introduced into a single distillation column 10 through an inlet 2 typically at about 5 atmospheres absolute and at a temperature of about its dew point. The column 10 is provided with a suitable number of liquid-vapor contact trays (not shown) to enable the incoming air to be separated into an oxygen-enriched liquid which collects at the bottom and a nitrogen-enriched vapor which collects at the top. Liquid nitrogen reflux for the column 10 is provided through inlet 16 at its top and reboil is provided by a reboiler 14 in the bottom region thereof. The properties of the fluid mixture in the column 10 are such that a maximum concentration of argon is obtained in the liquid and vapor phases at a level below that of the inlet 2, and whereas the incoming air contains in the order of 0.9% by volume of argon, a liquid fraction typically containing on the order of 8% by volume of argon may be withdrawn from the column 10 through the outlet 4.

In order to form the reflux and reboil for the distillation column 10, it is necessary to do heat pumping work. To reduce the amount of energy required from an external source, another liquid-vapor contact column 20 is employed to mix liquid oxygen and gaseous nitrogen fractions from the distillation column 10 and thus produce liquid nitrogen which is returned to the column 10 as reflux. Accordingly, a liquid oxygen stream is withdrawn from the bottom of the column 10 through an outlet 6 and is mixed with a gaseous oxygen stream passing out of the mixing column 20 through the outlet 32. The resulting mixed stream flows through a condenser 30 and the condensate is introduced into the top of the column 20 through an inlet 22. Preferably the liquid oxygen that enters the column 20 through the inlet 22 is not pure. Gaseous nitrogen is taken from the top of the distillation column 10 through the outlet 8 and is passed into an inlet 24 at the bottom of the mixing column 20. The mixing column 20 operates at substantially the same pressure as the distillation column 10, preferably above 3 atmospheres, and is provided with a number of liquid-vapor contact trays (not shown) to enable intimate contact to take place between the liquid and vapor phases. It is desirable that the relationship between the liquid and the vapor on each tray is relatively close to equilibrium, and accordingly, the mixing column typically has a relatively large number of trays, for example 50 or more. Although the mixing column 20 is illustrated separate from the distillation column 10, it may be included in the distillation column 10 above a distillation zone therein.

As the liquid descends the column 20, it becomes progressively richer in nitrogen. Thus, a liquid nitrogen stream is able to pass out of the column 20 through an outlet 26 to form part of the liquid nitrogen reflux stream that enters the column 10 through the inlet 16. A mixed oxygen/nitrogen stream is withdrawn from an intermediate location in the column 20 through an outlet 28. The relative proportions of oxygen and nitrogen in the withdrawn stream are the same as those of oxygen and nitrogen in the incoming air. It is to be appreciated, however, that the stream withdrawn through the outlet 28 is relatively lean in argon compared with the air entering the distillation column 10 through the inlet 2 since most of the argon is subsequently withdrawn again through the outlet 4. If desired, an oxygen-enriched product can be withdrawn through the outlet 28 and the operating pressure of the column 20 can be selected so as to produce the stream at a pressure slightly in excess of the pressure at which it is desired to be supplied to a plant in which the stream can be utilized (for example in a combustion process).

We have found that operation of the mixing column 20 at pressures in excess of 3 atmospheres facilitates the recovery of energy in the form of liquid nitrogen reflux. Such recovery of energy is also facilitated by employing a condenser 30 at the top of the column 20 so as to enhance the reflux supplied to the column. Thus, oxygen in the gaseous phase is withdrawn from the top of the mixing column 20 through the outlet 32 and is condensed in the condenser 30, the resulting liquid oxygen being combined with the liquid oxygen being withdrawn from the distillation column 10 through the outlet 6 and then being fed to the mixing column 20 through the inlet 22. Preferably the liquid oxygen that enters the column 20 through the inlet 22 is not pure. The use of the condenser 30 in association with the mixing column 20 is described in our UK patent application No. 2 174 916 A.

We have further found that, particularly at pressures above 3 atmospheres, in order to maintain the operating conditions in the column 20 close to equilibrium, a second stream of vapor may be taken from a level of the column 20 intermediate the level of the outlet 28 and the top of the column and condensed in a condenser 40. The withdrawal of vapor at two levels, thereby maintaining the column 20 close to equilibrium, markedly increases its separation. The resulting condensate is returned to the column at a level below that at which the vapor for condensation is taken from the column. The level at which the condensate from the condenser 40 is returned to the column 20 is selected so that the composition of the condensate corresponds approximately to that of the liquid into which it is reintroduced. In order to provide cooling for the condenser 40, a stream of liquid is withdrawn from the column 10 through an outlet 38 at a level below that of the inlet 2. The liquid that is withdrawn from the column 10 through the outlet 38 is reboiled in the condenser 40 and resulting vapor is returned to the distillation column 10 at a level such that its composition corresponds approximately to that of the vapor into which it is reintroduced. Typically, the reboiled stream is reintroduced at a level below that which it was withdrawn. This "intermediate" reboiling of the liquid withdrawn from the column 10 through the outlet 38 also helps to improve the efficiency with which the distillation column 10 operates.

The argon-enriched liquid oxygen that is withdrawn from the distillation column 10 through the outlet 4 is subjected to further distillation or rectification in the column 50. Whereas in conventional air separation plants the column that is employed to distil such an argon-enriched oxygen stream is operated at substantially the same pressure as the distillation column from which the stream is taken, in preferred process and plants according to the present invention, the column 50 is operated at a lower pressure than the column 10, for example, at a pressure a little above atmospheric, e.g. one to two atmospheres absolute. Accordingly, the argon-containing liquid withdrawn through the outlet 4 is sub-cooled in a heat exchanger 94 and is then passed through a throttling valve 44 and enters the column 50 through an inlet 46 as liquid. This arrangement makes possible efficient operation of the argon column at any pressure selected within a relatively wide range of operating pressures. With such an arrangement, it becomes convenient to take a stream of nitrogen from the mixing zone and employ it to reboil the liquid in or from a bottom region of the second distillation column, thereby condensing the nitrogen. Resulting condensate is then preferably introduced into the top region of the first distillation column as reflux.

The column 50 is provided with liquid-vapor contact trays (not shown) in order to facilitate mass exchange between the liquid and vapor phases. The column 50 is further provided with a reboiler 52 at the bottom and a condenser 54 at the top thereof. A liquid oxygen fraction collects at the bottom of the column 50 and a stream of liquid oxygen is withdrawn from the column 50 through the outlet 56. Argon-enriched gas collects at the top of the column 50 and is withdrawn through an outlet 58 and condensed in condenser 54. Some of the resulting condensate is returned to the top of column 50 through an inlet 60 and the remainder is withdrawn through outlet 62 as a crude argon product. The argon product, which typically contains up to 20 percent by volume of oxygen, may be subjected to further purification using conventional techniques.

In accordance with an unique feature of the subject, the reboil for the argon column 50 is provided by taking a portion of the gaseous nitrogen leaving the top of the distillation column 10 through the outlet 8 and passing it through the reboiler 52, the nitrogen thereby being condensed. The resultant liquid nitrogen is returned to the column 10, being united with the liquid nitrogen that is withdrawn from mixing column 20 through outlet 26. Accordingly, the reboiler 52 also acts as a condenser providing reflux for the distillation column 10.

Although it is a desideratum that the vapor drawn from the top of the first distillation column be essentially free of argon, it may contain oxygen in a concentration of up to 20.95% by volume, corresponding to an oxygen concentration of upto 38% by volume in the liquid phase. In practice, it is desirable that the liquid at the top of the first distillation column contains from 1 to 10% by of oxygen, and preferably about 2.5% by volume of oxygen.

In order to reboil liquid at or from the bottom of the first distillation column 10 and to condense oxygen at or from the top of the mixing zone 20, nitrogen may be employed as the working fluid. In addition, it is generally desirable to take the argon product in the liquid phase and, accordingly, it is preferred to condense argon at or from the top of the second distillation column 50 in the condenser 54. One portion of the condensed argon is used as reflux of the second column 50 and a second portion is taken as product. Typically, a working fluid comprising nitrogen is employed to condense the argon.

In order to enhance the efficiency at which the argon column operates, a stream of vapor is preferably taken from a level of the second distillation column intermediate the top and that at which the argon-containing stream is introduced into such column. The stream of vapor is condensed and returned to the second column. Again, nitrogen is preferably employed to condense such stream.

Accordingly, in preferred embodiments of the invention, nitrogen is typically required at five different pressures to perform heat pumping duties for the subject apparatus. The apparatus according to the invention preferably includes a nitrogen distribution and refrigeration system to meet this need. The nitrogen is desirably taken from the top of the first distillation column 10 where the gaseous phase typically contains from 0.5 to 1% by volume of oxygen (and a balance of nitrogen).

Figure 2:
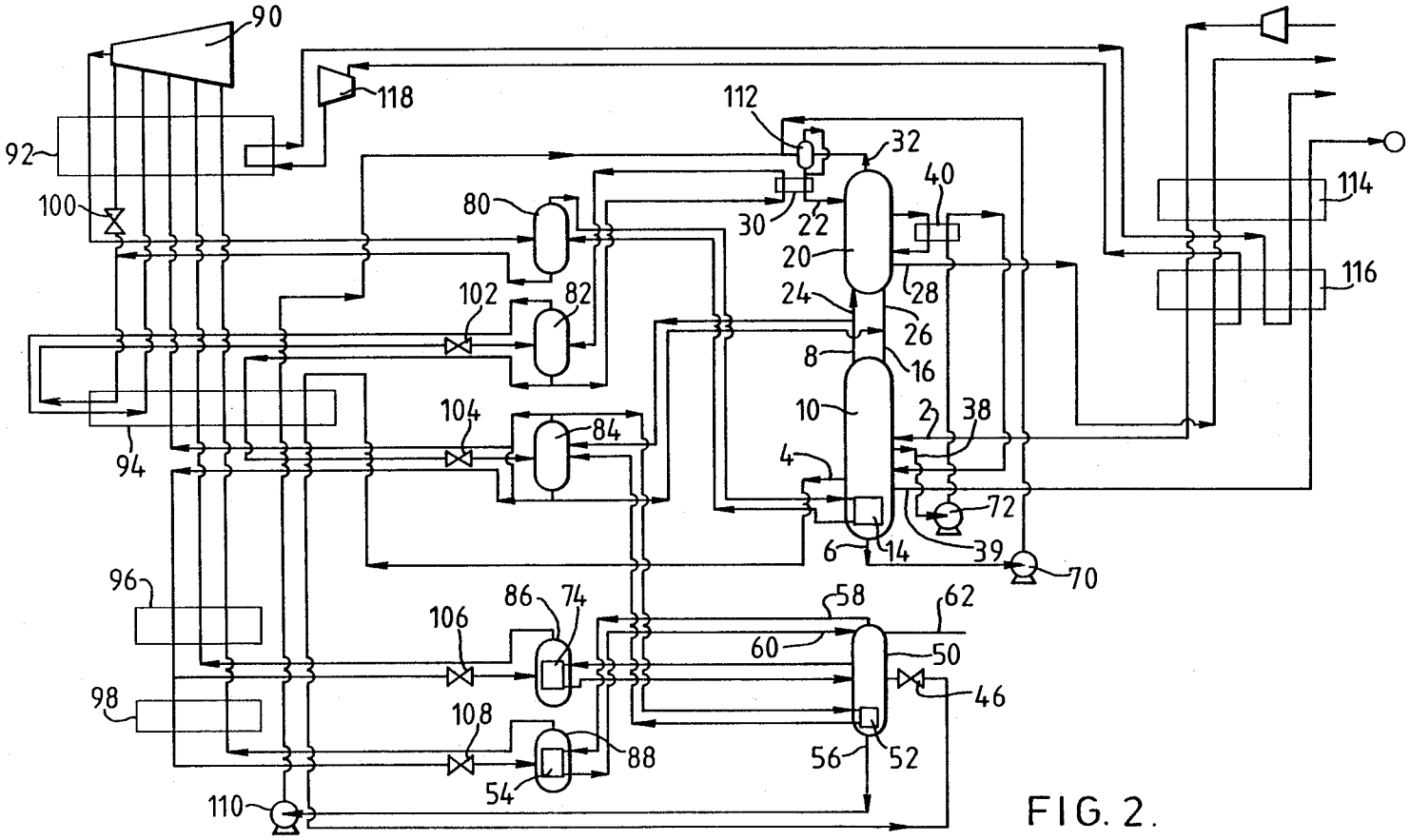
FIG. 2 is a circuit diagram of an argon generator employing the arrangement of columns shown in FIG. 1.

FIG. 2 illustrates a plant embodying the column system shown in FIG. 1. In the description of FIG. 2, the same reference numerals as used in FIG. 1 shall be employed to indicate items of plant that are common to both FIGURES. Moreover, the operation of those parts of the plant that are shown in FIG. 1 will not be described again in any detail. In the plant shown in FIG. 2, cooling for the condensers 30 and 54 and for the sub-cooler 94 may be provided by nitrogen generated in the distillation column 10. Similarily, such nitrogen may be employed as the source of heat for the reboiler 14.

The arrangement of columns employed in the plant shown in FIG. 2 is generally similar to that shown in FIG. 1. In order to assist the flow of liquid oxygen from the bottom of the distillation column 10 to the top of the mixing column 20, a pump 70 is employed, and a similar pump 72 is used to pump the liquid stream from the outlet 38 of the distillation column 10 through the condenser reboiler 40. An additional condenser 74 is employed in association with the argon column 50. Vapor is taken from the column 50 through an outlet above that of the inlet for the argon-enriched oxygen withdrawn from distillation column 10. This vapor is condensed in the condenser 74 and is returned to liquid in the column 50 at a level where the composition of the liquid corresponds approximately to that of the condensate. Moreover, liquid oxygen from the bottom of the column 50 is passed to the top of the mixing column 20 as will be described below. In other respects the arrangement of columns shown in FIG. 2 is generally similar to that shown in FIG. 1. It is contemplated within the scope of the invention to combine the argon-rich vapor condenser associated with the second distillation column 50 with the reboiler 14 for the first distillation column 10 in a condenser-reboiler.

The plant shown in FIG. 2 does, however, contain a number of features not shown in FIG. 1 or described with respect to thereto. In particular, the plant shown in FIG. 2 has the following features:

(a) a distribution and refrigeration system which in addition to providing a working fluid, comprising nitrogen, to the reboiler 52 of the argon column 50, also provides nitrogen to cool the condensers 54, 74 and 30 and nitrogen to heat the reboiler 14; and (b) a reversing heat exchanger system for purifying and cooling the incoming air.

The nitrogen distribution system includes five nitrogen distribution pots, 80, 82, 84, 86 and 88, operating at different pressures, which receive and distribute gaseous and liquid nitrogen streams performing heat pumping duty. The pots 80 and 82 provide nitrogen at higher pressure than the operating pressure of the columns 10 and 20 to the reboiler 14 and the condenser 30, respectively. The pressure in the pot 80 is higher than that of the pot 82 which houses the condenser 30. The pot 84 operates at approximately the same pressure as the columns 10 and 20 and provides an intermediate region of the vapor path from the outlet 26 of the mixing column 20 to the reboiler 14 of the distillation column 10 and also an intermediate region of the liquid path from the reboiler 14 of the column 10 through inlet 8.

The pots 86 and 88 operate at lower pressures than the columns 10 and 20 with pot 86 operating at the lowest pressure. Pot 86 contains and provides cooling for the condenser 74 associated with the argon column 50 while pot 88 contains and provides cooling for the condenser 54 associated with the argon column 50.

In addition to providing gaseous nitrogen to the reboiler 14 and receiving liquid nitrogen therefrom, the pot 80 receives a compressed gaseous nitrogen stream from a multistage compressor 90. Cooling for nitrogen supplied to the pots 80, 82, 84, 86 and 88, is provided by a sequence of heat exchangers 92, 94, 96 and 98. A compressed nitrogen stream leaving the compressor 90 flows through the heat exchanger 92 from its warm end at about ambient temperature and is cooled to about its dew point and introduced into the pot 80. A stream of liquid nitrogen is withdrawn from the bottom of the pot 80 at a rate equal to that which the compressed nitrogen is introduced into the pot 80, and is then divided in two. One part of the stream is expanded through valve 100 and returned through the heat exchanger 92 countercurrently to the aforesaid compressed nitrogen stream. After being warmed to about ambient temperature, this nitrogen is then returned to the highest pressure stage of the compressor 90 for recompression.

That part of the liquid nitrogen stream withdrawn from the bottom of the pot 80 that is not expanded through the valve 100 is further reduced in temperature in the heat exchanger 94: it enters the heat exchanger 94 at its warm end, is withdrawn from an intermediate region thereof, passed through an expansion valve 102 and introduced as liquid into the pot 82.

The pot 82 provides a liquid nitrogen stream to condense the oxygen in the condenser 32 associated with the mixing column 20 and receives the resultant vaporized nitrogen. Pot 82 also provides cooling for the heat exchangers 94 and 92 by a gaseous nitrogen stream which is then recompressed in a stage of the compressor 90. Thus, the gaseous nitrogen stream is withdrawn from the top of the pot 82, introduced into the heat exchanger 94 at a region intermediate its cold and warm ends and leaves the heat exchanger 94 at its warm end. This nitrogen stream then passes through the heat exchanger 92 from its cold end to its warm end and is recompressed in the compressor 90.

A liquid nitrogen stream is also withdrawn from the pot 82, passed through the heat exchanger 94 from its warm to its cold end and expanded through valve 104 into the pot 84. The pot 84 receives nitrogen from the outlet 26 of the mixing column 20, provides nitrogen to the condenser 14, receiving return nitrogen, provides nitrogen to the top of the distillation column 10 through the inlet 16, provides liquid nitrogen to the pots 86 and 88 and returns gaseous nitrogen to the compressor 90. Thus, a gaseous nitrogen stream withdrawn from the top of the pot 84 flows through the heat exchangers 94 and 92, from their cold end to their warm end, and is then compressed in a stage of the compressor 90. Thus, the gaseous nitrogen stream is mixed with some liquid withdrawn from the pot 84. Further liquid from the bottom of the pot 84 passes through heat exchanger 96 flowing from its warm to its cold end. Part of this liquid nitrogen is then expanded through valve 106 into the pot 86, while the remainder flows through the heat exchanger 98 from its warm to its cold end and is expanded through valve 108 into the pot 88. A gaseous nitrogen stream is withdrawn from the top of the pot 86 and returned to the compressor 90 flowing sequentially through the heat exchangers 96, 94 and 92. Similarly, a gaseous nitrogen stream withdrawn from the top of the pot 88 flows sequentially through the heat exchangers 98, 96, 94 and 92 and is recompressed in the compressor 90.

In addition to providing cooling and warming of the nitrogen streams, heat exchanger 94 sub-cools the argon enriched oxygen stream withdrawn from the column 10 through the outlet 42. In addition, liquid oxygen, withdrawn from the argon column 50 through the outlet 56, is pumped by a pump 110 through the heat exchanger 94 countercurrently to the flow of the argon-enriched liquid oxygen stream and is then mixed with the liquid oxygen stream pumped from the outlet 6. The resulting mixture is introduced into a pot 112 where it is mixed with gaseous oxygen leaving the top of the mixing column 20 through the outlet 32. The resulting 2-phase mixture is withdrawn from the pot 112 and is fully condensed in the condenser 30 before being returned to the column 20 through the inlet 22.

In order to provide cooling and cleaning for the incoming air stream, reversing heat exchangers 114 and 116 are provided. The air is cooled to its dew point by passage through the heat exchangers 114 and 116. Refrigeration for the heat exchangers is provided by taking the nitrogen-oxygen stream vented from the column 20 through the outlet 28. A part of the aforesaid nitrogen-oxygen stream is withdrawn upstream of the cold end of the heat exchange 116 and is passed through the heat exchanger 116, passed through the heat exchanger 116 countercurrently to the incoming air stream and expanded to a pressure a little above atmospheric pressure in an expansion turbine 118 thereby recovering energy. The resulting stream provides some refrigeration for the heat exchanger 92 and is then returned through the heat exchanger 116 flowing first cocurrently with the incoming air stream and then countercurrently to the incoming air. The stream then passes through the heat exchanger 114 from the cold to the warm end and is withdrawn. The nitrogen-oxygen streams that leave the warm end of the heat exchanger 114 may be vented or further expanded to recover energy.

During passage of the incoming air through the heat exchangers 114 and 116, carbon dioxide, water vapor and other low volatility impurities are removed and deposited. In a manner well known in the art, once the cleaning ability of the reversing heat exchanger 114 and 116 begins to decline, the passages traversed by the incoming and returning air streams are switched so that the returning nitrogen/oxygen streams can be used to resublime solid impurities deposited on the heat exchange surfaces. Thus, the heat exchangers 114 and 116 may be used continuously to provide purified air to the inlet of the distillation column 10. It is desirable to employ relatively high and low pressure streams to effect the cleaning of the heat exchangers 116 and 114 as difficulties can arise if just a relatively high pressure air stream is used, that is if none of the air is expanded through the turbine 118.

In an illustrative example of the method according to the invention employing the plant shown in FIG. 2, air enters the distillation column 10 through the inlet 2 at a flow rate of 1000 standard cubic meters per hour a temperature of about 101.5 K and 5.5 atmospheres absolute pressure. A liquid oxygen stream, enriched in argon, comprising approximately 92% by volume of oxygen and 8% by volume of argon, is withdrawn from the column 10 through the outlet 42 at a rate of 111.2 standard cubic meters per hour, about 110 K and about five and one half atmospheres absolute. It is sub-cooled to 92 K by passage through the heat exchanger 94 and then expanded to a pressure of about 1.3 atmospheres absolute through the valve 46, prior to being introduced into the column 50. A liquid oxygen stream comprising about 99.9% by volume of oxygen and 0.1% of argon is withdrawn from the bottom of the argon column 50 at a flow rate of about 102.3 standard cubic meters per hour, a temperature of about 93.5 K and a pressure of about 5.15 atmospheres absolute. This liquid oxygen stream is warmed to about 105.5 K in the heat exchanger 94 and mixed with liquid oxygen from the bottom of the distillation column 10. The resulting mixture is in turn mixed in pot 112 with vaporous oxygen leaving the mixing column 20. The resulting mixture is fully condensed in the condenser 30 and is introduced into the top of the mixing column 20. This stream typically comprises 97.5% by volume of oxygen with the balance being nitrogen and argon. Liquid argon (comprising 98% by volume of argon, 1.8% by volume of oxygen and 0.2% by volume of nitrogen) is withdrawn from the top of the column 50 through the outlet 62 at a rate of about 9 standard cubic meters per hour.

The nitrogen streams passing to and from the pots 80, 82, 84, 86 and 88 are of the same purity as the nitrogen vapor from the top of the distillation column 10, i.e. typically containing about 1% by volume of oxygen. The pot 80 operates at an average pressure of about 17¼ atmospheres absolute and a temperature of 116 K; the pot 82 at about 11 atmospheres absolute and about 105 K; the pot 84 at about 5.4 atmospheres absolute and about 95 K; the pot 86 at about 3.5 atmospheres absolute and about 89.5 K; and the pot 88 at about 2 atmospheres absolute, and about 84 K.

The flow rates of nitrogen into and out of the compressor are as follows. Nitrogen from the pot 88 enters the lowest pressure stage of the compressor 90 at a pressure of 1.75 atmospheres and a flow rate of about 146.8 standard cubic meters per hour; nitrogen from the pot 82 enters the next stage of the compressor 90 at a pressure of 3.23 atmospheres and at a flow rate of 196.5 standard cubic meters per hour; nitrogen from the pot 84 enters the next stage of the compressor 90 at a pressure of 5.22 atmospheres and a flow rate of 68.8 standard cubic meters per hour. Nitrogen from the pot 82 enters the next stage of the compressor at a pressure of 10.86 atmospheres and a flow rate of 317.0 standard cubic meters per hour; and nitrogen from the pot 80 enters the highest pressure stage of the compressor 90 at a pressure of 17.4 atmospheres absolute and a flow rate of about 30.0 standard cubic meters per hour. Compressed nitrogen leaves the highest pressure stage of the compressor 90 at a pressure of 17.3 atmospheres absolute and a flow rate of 759 standard cubic meters per hour. A mixed nitrogen-oxygen stream is withdrawn from the mixing column 20 at a rate of 991 standard cubic meters per hour and a temperature of about 99 K. Of this stream, 798.3 standard cubic meters per hour flows straight through the heat exchangers 116 and 114, being vented to atmosphere from the warm end of the heat exchanger 114 at approximately ambient temperature. The remainder of the stream leaves the heat exchanger 116 at a temperature of 180 K and is expanded to a pressure of about 1.25 atmospheres and a temperature of 130 K in the expansion turbine 118. The stream is then warmed to a temperature of 64.5 K in the heat exchanger 92 before returning from the warm end to the cold end of the heat exchanger 116 and then flowing back through the heat exchanger 116 and the heat exchanger 114, and being vented to the atmosphere.

The gaseous stream of intermediate composition withdrawn from the column 20 for condensation in the heat exchanger 40 comprises about 57% by volume of oxygen about 42.9% by volume of nitrogen and 0.09% by volume of argon. The liquid stream withdrawn from the first distillation column 10 through the outlet 38 for reboil in the heat exchanger 40 against the condensing gaseous stream of intermediate composition comprises about 38.8% by volume of oxygen, about 59.1% by volume of nitrogen, and 2.1% by volume of argon. The flow rate of this liquid stream is 170 standard cubic meters per hour whereas the flow rate of the gaseous stream against which it is heat exchanged in the heat exchanger 40 is 183 standard cubic meters per hour.

I claim:

1. A process of separating air, comprising the steps of:

(a) introducing a stream of air into a first distillation column;

(b) withdrawing an oxygen-rich liquid from a bottom region of the first distillation column and introducing it into a top region of a mixing zone;

(c) withdrawing nitrogen-rich vapor from the first distillation column and introducing it into a bottom region of the mixing zone;

(d) establishing through the mixing zone a downward flow of liquid that becomes progressively richer in nitrogen and an upward flow of vapor that becomes progressively richer in oxygen;

(e) withdrawing liquid nitrogen from the mixing zone and introducing it into the top of the first distillation column to act as reflux;

(f) withdrawing as product or waste a mixed stream comprising oxygen and nitrogen from a chosen level of the mixing zone;

(g) providing condensation for oxygen-rich vapor at the top of the mixing zone;

(h) withdrawing from the first distillation column a stream enriched in argon relative to the air stream, and separating an argon product from the argon-containing stream in a second distillation column; and (i) withdrawing a vapor stream from a level of the mixing zone intermediate the level from which said mixed stream is withdrawn and the top thereof, condensing said vapor stream in heat exchange with a stream of boiling liquid from one of the distillation columns, returning a stream of thus-formed condensate to the mixing zone, and returning the boiled liquid to said distillation column.

2. A process in accordance with in claim 1, wherein in step (i), the stream of liquid is withdrawn from the first distillation column at a level below that at which air is introduced, and the boiled liquid is returned to the column at a level below that from which said stream is withdrawn.

3. A process in accordance with claim 1, wherein the second distillation column operates at a lower pressure than the first distillation column, and the argon-enriched stream is withdrawn from the first column as a liquid, sub-cooled and introduced into the second column through a throttling valve.

4. A process in accordance with claim 1, wherein a stream of nitrogen vapor is withdrawn from the mixing zone, utilized to reboil liquid in or from a bottom region of the second distillation column, being thereby condensed, and the resulting condensate is introduced into the first distillation column as reflux.

5. A process in accordance with claim 1, wherein nitrogen is employed as a working fluid to reboil liquid at or from the bottom of the first column, and to condense oxygen at or from the top of the mixing zone.

6. A process in accordance with claim 1, additionally including the step of condensing argon at or from the top of the second distillation column, employing one portion of the condensed argon as reflux for the second column and withdrawing a second portion of the condensed argon as product.

7. A process in accordance with claim 1, wherein low volatility impurities are removed from the air stream in one or more reversing heat exchangers upstream of the first distillation column, said reversing heat exchangers are cleaned by said mixed stream withdrawn from the mixing zone in step (f), additionally including the step of expanding a part of the mixed stream, so as to give cleaning gas at two different pressures.

8. A process in accordance with claim 1, additionally including the step of withdrawing a stream of liquid oxygen from the bottom of the second column and introducing it into the top of the mixing zone.

9. A process in accordance with claim 1, wherein the mixed stream withdrawn in step (f) has a ratio of oxygen to nitrogen greater than that of the incoming air stream and is taken as product.

10. A process in accordance with claim 1, wherein the liquid nitrogen at the top of the first distillation column contains from 1 to 10% by volume of oxygen.

11. A process in accordance with claim 1, additionally including the step of withdrawing a stream of vapor from a level of the second distillation column intermediate that at which the argon-enriched stream is introduced therein and the top thereof condensing the stream of vapor and returning it to the second column.

12. Apparatus for separating argon from air, comprising:

(a) means for introducing a stream of air into a first distillation column;

(b) means for withdrawing an oxygen-rich liquid from a bottom region of the first distillation column and introducing it into a top region of a mixing zone;

(c) means for withdrawing nitrogen rich vapor from the first distillation column and introducing it into a bottom region of the mixing zone;

(d) liquid-vapor contact means for establishing through the mixing zone a downward flow of liquid that becomes progressively richer in nitrogen and an upward flow of vapor that becomes progressively richer in oxygen;

(e) means for withdrawing liquid nitrogen from the mixing zone and introducing it into the first distillation column to act as reflux;

(f) means for withdrawing as product or waste a mixed stream comprising oxygen and nitrogen from a chosen level of the mixing zone;

(g) a condenser for condensing oxygen-rich vapor at the top of the mixing zone;

(h) means for withdrawing from the first distillation column a stream enriched in argon relative to air, said means communicating with a second distillation column for separating an argon product from the argon-enriched stream; and (i) means for withdrawing a vapor stream from a level of the mixing zone intermediate that from which said mixed stream is, in operation, withdrawn at the top, means for condensing said vapor stream in heat exchange with a stream of boiling liquid withdrawn from one of the distillation columns, means for returning a stream of thus-formed condensate to the mixing zone, and means for returning boiled liquid to said distillation column.

13. Apparatus in accordance with claim 12, wherein said boiling liquid is withdrawn from the first distillation column.

14. Apparatus in accordance with claim 12 including means for sub-cooling said argon-enriched stream and a throttling valve through which in said sub-cooled argon-enriched stream is introduced into said second distillation column.

15. Apparatus in accordance with claim 12, wherein the second distillation column is provided with a reboiler for boiling liquid in or from the bottom thereof, said reboiler having an inlet in communication with an outlet of the bottom of the mixing zone and an outlet in communication with an inlet for reflux to the first distillation column.

16. Apparatus in accordance with claim 12, additionally including a condenser associated with the top of the second distillation column, said condenser being adapted to return one portion of argon condensed therein to the second column as reflux, there also being an outlet for liquid argon product in communication with said condenser.

* * * * *